US006595128B2

(12) United States Patent
Parks

(10) Patent No.: US 6,595,128 B2
(45) Date of Patent: Jul. 22, 2003

(54) GOLF BALL STENCIL

(76) Inventor: Casey D. Parks, 18 N. Washington Blvd., Hamilton, OH (US) 45013

( * ) Notice: Subject to any disclaimer, the term of this patent is extended or adjusted under 35 U.S.C. 154(b) by 0 days.

(21) Appl. No.: 09/892,423

(22) Filed: Jun. 27, 2001

(65) Prior Publication Data

US 2002/0005124 A1 Jan. 17, 2002

Related U.S. Application Data

(60) Provisional application No. 60/217,686, filed on Jul. 12, 2000.

(51) Int. Cl.[7] ..... B41F 17/30

(52) U.S. Cl. ..... 101/127; 101/129; 101/DIG. 40

(58) Field of Search ..... 101/35, 114, 127, 101/129, DIG. 40; 473/406; 33/562

(56) References Cited

U.S. PATENT DOCUMENTS 5,878,659 A * 3/1999 Hatter ..... 101/35
6,004,223 A * 12/1999 Newcomb ..... 101/127
6,209,452 B1 * 4/2001 Klimek ..... 101/27
6,216,587 B1 * 4/2001 Foley ..... 101/35

* cited by examiner

*Primary Examiner*—Stephen R. Funk
(74) *Attorney, Agent, or Firm*—Grimes & Battersby, LLP

(57) ABSTRACT

A device is provided for imprinting a solid or dashed straight line on the surface of a golf ball. The device consists of a semi-rigid stencil that may be snapped securely around the surface of a golf ball. While the golf ball is allowed to rotated freely within the stencil so as to allow a user to rotate the ball to the correct position, a pair of finger grips are provided which, when compressed, clamp the ball in position so as to prevent the ball from rotating while the ball is being marked. The stencil also includes a linear groove adapted to receive a pen, indelible marker or other writing implement for marking the ball with a linear indicia. This indicia can be used for identification purposes, as a putting trainer, and an alignment aid during play. Beveled edges or bumpers may also be included along the inner surface of the groove to assist the user in imprinting the ball and prevent smudging or pooling of the ink or paint used to mark the ball.

9 Claims, 2 Drawing Sheets

GOLF BALL STENCIL

RELATED APPLICATIONS

This is a non-provisional application claiming the benefit of U.S. Provisional Patent Application Serial No. 60/217,686 filed on Jul. 12, 2000 in the name of Casey D. Parks for "Golf Ball Stencil."

BACKGROUND OF THE INVENTION

1. Field of the Invention

The present invention relates generally to a stencil for sports balls, and more particularly to a stencil for imprinting a thin straight line on a golf ball using a pen or indelible marker, which line may be used by a golfer as a visual aid for club alignment and swing path, and serve as a training aid to assist a golfer in improving their swing and follow-through. The stencil is particularly useful for imprinting either a solid or dashed straight line on a golf ball, since the dimpled and irregular surface of the golf ball makes it difficult, if not impossible, to draw a straight line across the surface of the ball by freehand.

2. Description of the Prior Art

Devices for and methods of marking golf balls have long been known in the art. Marks or other indicia imprinted upon the surface of a golf ball are usually designed with one of two purposes in mind. First, while playing golf, especially in any type of tournament competition, it is usually required that a player mark his or her golf ball for identification purposes, in case another player on the golf course is using the same brand and number ball. Players usually mark their balls with a dot, series of dots, or a straight thin line. This straight line is also useful for the second purpose of the indicia—as a visual aid during play. This line can be used by a golfer to ensure proper club alignment and swing path, as well as serve as a training aid.

Since the dimpled surface of the golf ball make it almost impossible to draw a thin straight indicia using a pen or marker on the ball, most players are forced to use the dot method, which is useless as a visual aid in alignment during play. Accordingly, various devices and methods have been developed to assist the user in imprinting a mark upon the surface of the golf ball. For example, U.S. Pat. No. 6,213,012, which issued to Arms on Apr. 10, 2001 for a "Golf ball marking device" discloses a device for drawing a line around the circumference of a golf ball having an inner wall, an outer wall, and a top wall, whereby the golfer inserts the golf ball into the golf ball marking device, and using the top wall as a guide, places a mark on the circumference of the golf ball using a marking utensil.

Similarly, U.S. Pat. No. 6,004,223, which issued to Newcomb on Dec. 21, 1999 for a "Golf ball stencil" discloses an alignment aid for golfers consisting of a rigid hemispherical body having two intersecting slits therein for making a mark on a golf ball which indicates the intended path of the golf ball and the preferred orientation of the club face for obtaining the intended path of the golf ball. While the device in Newcomb may be adequate for beginning or average golfers since the indicia is so bold, an advanced player does not want or need such a large cross-haired mark. An advanced golfer needs only a simple straight line which is used to line up the putter perpendicular to the indicia, instead of lining the putter up parallel to the indicia on Newcomb's design.

Another example of imprinting a golf ball is shown in U.S. Pat. No. 6,179,732, which issued to Inoue, et al. on Jan. 30, 2001 for a "Golf ball and golf ball marking method," which discloses a method for marking the surface of a golf ball at the same time as the ball is molded in a two-part mold having an inner wall defining a spherical cavity. The marking method includes affixing a mark bearing film to the surface of a covered body comprising a core enclosed within a pair of half-cups, then compression molding the covered body.

Various templates may also be used to mark the ball with different designs, shapes and characters, such as is disclosed in U.S. Pat. No. 5,878,659, which issued to Hatter on Mar. 9, 1999 for a "Template for marking a golf ball." Hatter discloses a template for marking golf balls with identifying indicia including an elongated, rectangular-shaped main body member which is foldable into a cylinder for encompassing the golf ball, a central body portion having a plurality of apertures in the form of letters, numbers, and other symbols arranged thereon, a first end having a flexible tongue formed from a U-shaped slot, and a second end having a transverse slot. When the main body member is rolled into a cylinder for receiving a golf ball for marking, the tongue is inserted through the slot for maintaining the cylindrical form, whereupon the point of a pen can be successively inserted through the appropriate apertures on the central body portion in order to mark the golf ball with an identifying name, symbol, expression, monogram or moniker.

More high-tech methods for imprinting golf balls have also been devised. For example, in U.S. Pat. No. 5,248,878, which issued to Ihara on Sep. 28, 1993 for a "Golf ball marking method," a method for marking a golf ball is disclosed whereby the ball is marked by directing laser light to a selected surface portion of the ball, thereby causing the exposed surface layer portion to change its color. The discolored portion forms an identification mark on the ball surface.

Additional examples of marking devices are also disclosed in U.S. Pat. Nos. 5,662,530; 4,974,511; and 4,441,716. These previous inventions relating to the markings on the golf ball, including alignment aids, training aids, and markings for the sole purpose of identifying ones ball, are a bit complex for beginners and impracticable for advanced players since advanced players already know how to set up square to a golf ball. These inventions are visually distracting to an advanced player and a bit complex for a beginning player. Golfers who have spent years playing golf need a more refined tool for identifying their golf ball, and there is a need for a golf ball marking device that provides tournament-caliber players, who find current inventions unacceptable for tournament play, a more precise tool for marking their ball.

SUMMARY OF THE INVENTION

Against the foregoing background, it is a primary object of the present invention to provide an device for marking a golf ball with either a solid or dashed straight line to assist a golfer in identifying his or her ball and aligning the ball with the club or putter.

It is another object of the present invention to provide such a device that is simple to use.

It is yet another object of the present invention to provide such a device that is convenient and easy to store.

It is still another object of the present invention to provide such a device that may be utilized by both amateur and professional golfers.

It is another object of the present invention to provide such a device that prevents smearing or pooling of ink on the surface of the golf ball.

It is yet another object of the present invention to provide such a device that is may be used to create a straight indicia 230 degrees around the golf ball.

To the accomplishments of the foregoing objects and advantages, the present invention, in brief summary, comprises a device for imprinting a solid or dashed straight line on the surface of a golf ball. The device consists of a semi-rigid stencil that may be snapped securely around the surface of a golf ball. While the golf ball is allowed to rotated freely within the stencil so as to allow a user to rotate the ball to the correct position, a pair of finger grips are provided which, when compressed, clamp the ball in position so as to prevent the ball from rotating while the ball is being marked. The stencil also includes a linear groove adapted to receive a pen, indelible marker or other writing implement for marking the ball with a linear indicia. This indicia can be used for identification purposes, as a putting trainer, and an alignment aid during play. Beveled edges or bumpers may also be included along the inner surface of the groove to assist the user in imprinting the ball and prevent smudging or pooling of the ink or paint used to mark the ball.

The device is designed to present golfers with a precise and easy to use marking tool, which creates a very fine straight indicia, at any length, on a golf ball. This indicia can be used for identification purposes, especially during a tournament round of golf. Few putts in golf are straight, meaning they do not curve to the left or right. A golfer when faced with a putt that does curve to the right or left, must decide how much the putt will break and then aim the ball the appropriate distance to the side of the hole. With the present invention the player will simply line the indicia on the ball with the exact line in which he or she wants their ball to initially start traveling. This allows a golfer to approach each putt as if it were straight, and not be worrying about how much the putt breaks, but how hard he or she has to hit. The indicia is also a visual putting trainer. If one draws a complete equatorial indicia on a golf ball one can quickly determine if a ball was struck with a straight putting stroke. A golfer will pick out a straight putt on practice green, line the indicia up at the hole, and putt the ball. If the line does not wobble the ball was struck square, if the line wobbles the stroke was either outside in, or inside out.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
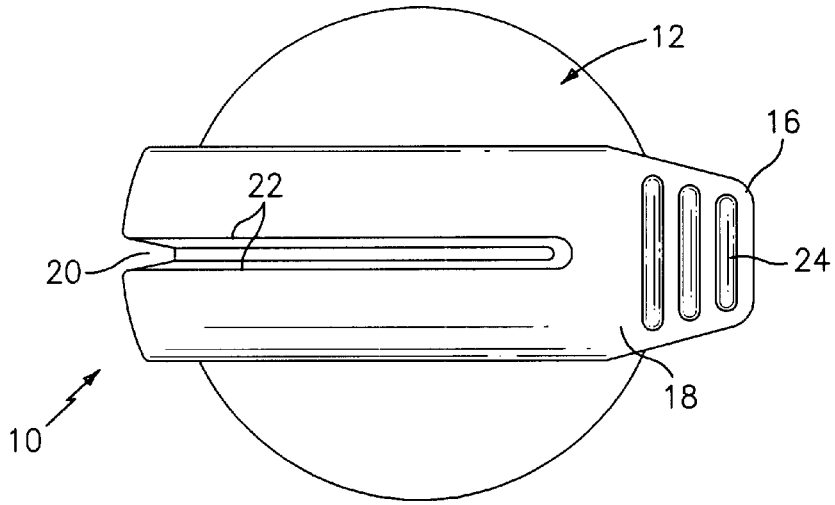
FIG. 1 is a side elevational view of the ball of the present invention.
Figure 2:
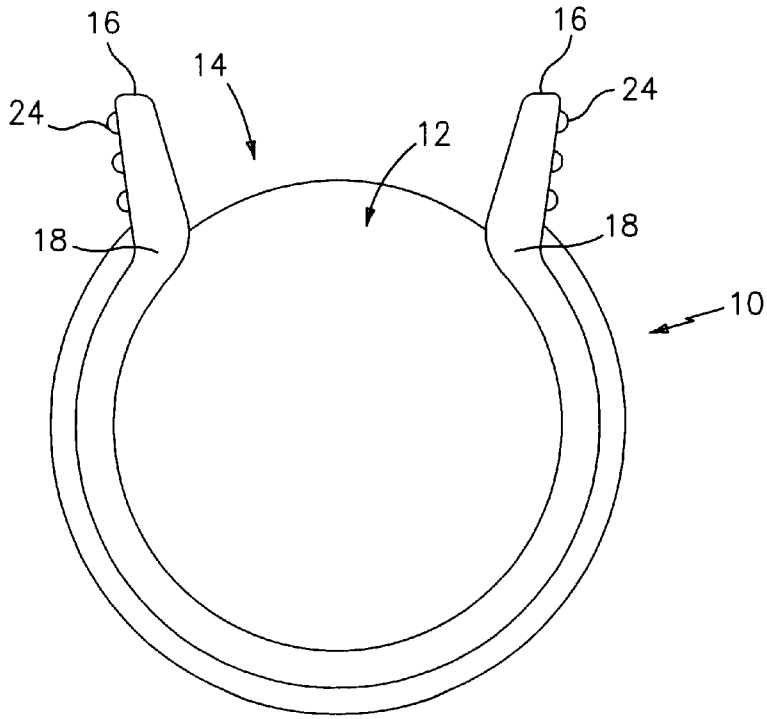
FIG. 2 is a front elevational view of the ball of the present invention.
Figure 3:
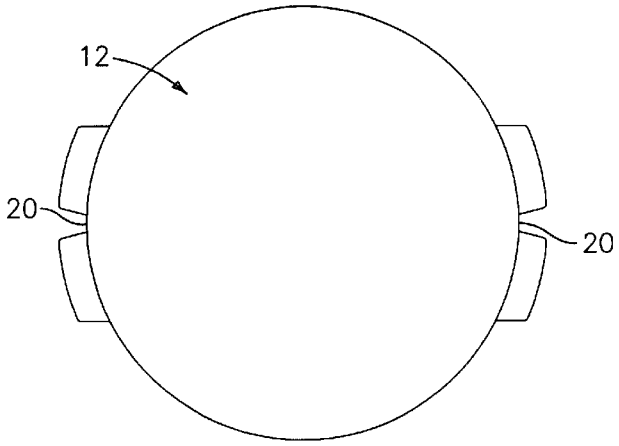
FIG. 3 is a cross-sectional view of the ball of FIG. 1 taken through the center thereof.
Figure 4:
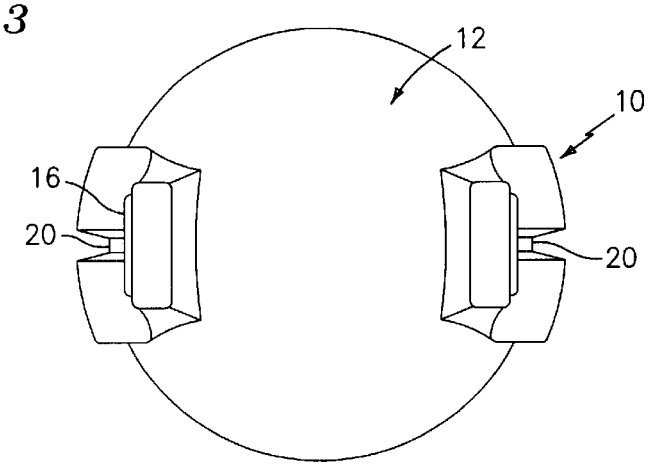
FIG. 4 is a top elevational view of the ball of the present invention.
Figure 5:
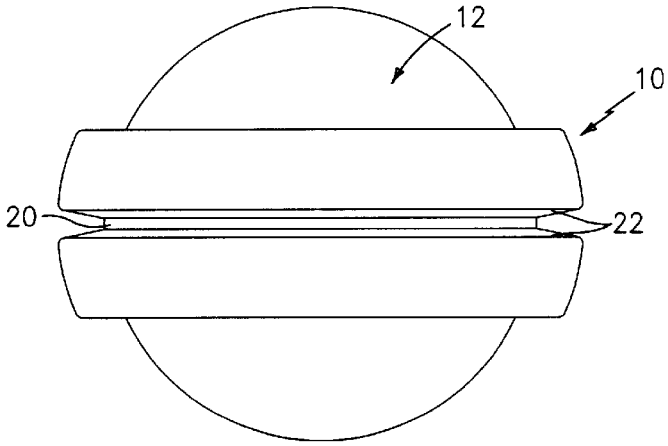
FIG. 5 is a bottom elevational view of the ball of the present invention.

Referring to the drawings and, in particular, to FIGS. 1 and 2 thereof, the ball marking device of the present invention is provided and is referred to generally by reference numeral 10. In the preferred embodiment, the ball marking device 10 is composed of either plastic or a similar rigid, yet flexible material that will allow the device 10 to deform slightly in order to allow the insertion of a U.S.G.A. approved golf ball 12. While being generally circular in shape, the ball marking device 10 includes an opening 14 defined by two opposing finger grips 16. The length of the opening 14 is somewhat smaller than the diameter of the golf ball 12 such that when the golf ball 12 is inserted into the device 10 it is prevented from escaping by the opposite ends 18 that are terminated by the finger grips 16. The inner diameter of the ball marking device 10 is slightly larger than the diameter of the golf ball 12 such that the ball 12 may be allowed to rotate freely while inserted within the marking device 10.

Disposed within the center of the marking device 10, running radially around the length thereof is a linear groove 20. Said groove 20 is adapted to receive and guide a pen or other marking device similar to a stencil, allowing a user to imprint a linear mark around the surface of the golf ball 12. In the preferred embodiment, the groove 20 includes at least one bevel 22 to facilitate the marking of the ball. In an alternate embodiment, a bumper may also be included within said groove 20 which, in combination with the bevel 22, serve to prevent smudging or pooling of the ink on the surface of the ball 12.

In the preferred embodiment, the finger grips 16 include a plurality of ridges 24 which provide traction and assist the user in grasping and compressing the marking device 10 during operation.

The dimensions of the marking device 10 of the present invention, in the preferred embodiment, are approximately ¾" wide, ⅛" thick, and 4¼" long wrapping around more than 75% of the circumference of a golf ball. The beveled groove 20 running down the center is approximately 1/16 inch wide at the base, and ⅛ inch wide at the surface. The inside diameter of the marking device is approximately 1.68 inch and is contoured to be form fitting to any U.S.G.A. approved golf ball, although the diameter may be slightly larger as indicated below. In the preferred embodiment the marking device 10 is made of a transparent or translucent material to allow a user to see through the device 10 to the surface of the ball 12.

In operation a golfer will snap his ball 12 into the marking device 10 by forcing apart the opposite ends 18. Once inserted, the ends 18 return to their original position, thereby retaining the ball 12 in place within the marking device 10. The golfer may then rotate the ball 12 to the desired position or positions for the application of the mark or indicia. Once the desired position is reached, the golfer compresses the two finger grips 16, which forces the two ends 18 closer to each other, thereby clamping the ball 12 in place and preventing it from moving while the ball is being marked. Since the marking device 10 is made from a transparent or translucent plastic, the golfer may visually fine tuning the ball 12 to the exact position desired. A fine point permanent marker is inserted into the beveled groove 20 and is used to make a straight line of any length that the golfer desires. The beveled groove 20 is 3¼" long making it very simple to connect these lines with one repositioning of the stencil, if a complete equatorial indicia is desired.

Having thus described the invention with particular reference to the preferred forms thereof, it will be obvious that various changes and modifications can be made therein without departing from the spirit and scope of the present invention as defined by the appended claims.

I claim:

1. A device for marking the surface of a golf ball with a marker, said device comprising an arcuate stencil to receive and retain said golf ball, said stencil having a narrow profile and wrapping around said golf ball while allowing said ball to rotate freely to a desired position and further including means to clamp said golf ball once said desired position has been attained, wherein said stencil includes at least one narrow, bevelled groove disposed therethrough and extending 270 degrees around said stencil, said groove serving to receive and guide said marker for imprinting a line on said surface of said ball.

2. The marking device of claim 1, wherein said stencil is composed of a resilient yet deformable material.

3. The marking device of claim 2, wherein said material is transparent or semi-transparent.

4. The marking device of claim 3, wherein said material is plastic.

5. The marking device of claim 1, wherein said means for clamping comprises finger grips situated at opposite ends of said stencil, said finger grips being adapted to deform said stencil when pressure is applied thereto.

6. The marking device of claim 1, wherein said stencil is approximately 0.75 inch wide, 0.125 inch thick, 4.25 inches long, and the inside diameter thereof is approximately 1.68 inch and is contoured to fit to a U.S.G.A. approved golf ball.

7. The marking device of claim 1, wherein said beveled groove is approximately 0.0625 inch wide at the base, and 0.125 inch wide at the surface.

8. A device for marking the surface of a golf ball with a marker, said device being composed of a resilient yet deformable transparent plastic and comprising an arcuate stencil to receive and retain said golf ball, said stencil having a narrow profile and wrapping around said golf ball while allowing said ball to rotate freely to a desired position and further including means to clamp said golf ball once said desired position has been attained, said means for clamping comprises finger grips situated at opposite ends of said stencil, said finger grips being adapted to deform said stencil when pressure is applied thereto, wherein said stencil includes at least one narrow, bevelled groove disposed therethrough and extending 270 degrees around said stencil, said groove serving to receive and guide said marker for imprinting a mark on said surface of said ball.

9. A method for marking the surface of a golf ball with a marker, said method comprising the steps of:

providing a ball-marking device comprising an arcuate stencil to receive and retain said golf ball, said stencil having a narrow profile and wrapping around said golf ball while allowing said ball to rotate freely to a desired position and further including means to clamp said golf ball once said desired position has been attained, wherein said stencil includes at least one narrow, bevelled groove disposed therethrough and extending 270 degrees around said stencil, said groove serving to receive and guide said marker for imprinting a mark on said surface of said ball;

inserting said golf ball within said ball-marking device;

rotating said golf ball until said desired position has been reached;

clamping said golf ball in said desired position;

inserting said marker into said groove; and marking said surface of said golf ball with said marker.

* * * * *